US009759105B2

(12) United States Patent
Krüger et al.

(10) Patent No.: US 9,759,105 B2
(45) Date of Patent: Sep. 12, 2017

(54) EXHAUST MUFFLER

(71) Applicant: Eberspächer Exhaust Technology GmbH & Co. KG, Neunkirchen (DE)

(72) Inventors: Jan Krüger, Neuhausen (DE); Georg Wirth, Kirchheim u. Teck (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 0 days.

(21) Appl. No.: 15/192,112

(22) Filed: Jun. 24, 2016

(65) Prior Publication Data

US 2016/0376953 A1 Dec. 29, 2016

(30) Foreign Application Priority Data

Jun. 25, 2015 (DE) ..... 10 2015 110 199

(51) Int. Cl.

| | |
|---|---|
| ***F01N 1/24*** | (2006.01) |
| ***F01N 1/16*** | (2006.01) |
| ***F01N 1/00*** | (2006.01) |
| ***F01N 1/08*** | (2006.01) |

(52) U.S. Cl.

CPC ..... *F01N 1/163* (2013.01); *F01N 1/003* (2013.01); *F01N 1/084* (2013.01); *F01N 1/166* (2013.01); *F01N 1/24* (2013.01); *F01N 2240/36* (2013.01); *F01N 2290/00* (2013.01)

(58) Field of Classification Search

CPC ..... F01N 1/163; F01N 1/166; F01N 1/084; F01N 1/24

USPC ..... 181/228, 227, 237, 254

See application file for complete search history.

(56) References Cited

U.S. PATENT DOCUMENTS

| | | | | |
|---|---|---|---|---|
| 7,434,570 | B2 * | 10/2008 | Hill | F01N 1/006 123/568.18 |
| 7,896,130 | B2 * | 3/2011 | Hill | F01N 1/166 123/568.18 |
| 2001/0018995 | A1 * | 9/2001 | Uegane | B60K 13/04 181/275 |

(Continued)

FOREIGN PATENT DOCUMENTS

| | | |
|---|---|---|
| DE | 197 20 410 A1 | 11/1997 |
| DE | 20 2005 009 092 U1 | 8/2005 |

(Continued)

*Primary Examiner* — Forrest M Phillips

(74) *Attorney, Agent, or Firm* — McGlew & Tuttle, P.C.

(57) ABSTRACT

An exhaust gas stream for an internal combustion engine includes a muffler housing (12) with a first chamber (14) and a second chamber (16). An exhaust gas inlet (24) has a first chamber opening area (30) and a second chamber opening area (32). An exhaust gas outlet (36) is open in an outlet opening area (42) towards the first chamber. A connection opening (50) is provided between the first chamber and the second chamber and has an exhaust valve arrangement associated therewith, including a valve element (56) including a closing area (58) closing the connection opening in a closed position of the exhaust valve arrangement (52). The exhaust valve arrangement includes an actuating area (64) associated with the inlet second opening area for generating an actuating force acting on the exhaust valve arrangement, moving from the closed position in the direction of an open position by exhaust gas bypass flow.

24 Claims, 1 Drawing Sheet

(56) References Cited

U.S. PATENT DOCUMENTS

| | | | | |
|---|---|---|---|---|
| 2002/0033303 | A1* | 3/2002 | Nagai | F01N 1/165 181/237 |
| 2007/0045043 | A1* | 3/2007 | Hoerr | F01N 1/003 181/250 |
| 2007/0272480 | A1* | 11/2007 | Kuroda | B01D 53/9454 181/254 |
| 2008/0245605 | A1* | 10/2008 | Maeda | F01N 1/084 181/254 |
| 2008/0302598 | A1* | 12/2008 | Nicolai | F01N 1/003 181/254 |
| 2011/0048848 | A1* | 3/2011 | Han | F01N 1/083 181/228 |

FOREIGN PATENT DOCUMENTS

| | | | |
|---|---|---|---|
| DE | 10 2004 040 631 | B3 | 2/2007 |
| DE | 11 2005 001 764 | T5 | 11/2008 |
| DE | 10 2007 026 811 | A1 | 12/2008 |
| DE | 10 2008 023553 | A1 | 11/2009 |
| EP | 2 000 637 | A1 | 12/2008 |
| EP | 2 818 660 | A1 | 12/2014 |
| JP | 2006-291 719 | A | 10/2006 |

* cited by examiner

EXHAUST MUFFLER

CROSS REFERENCE TO RELATED APPLICATIONS

This application claims the benefit of priority under 35 U.S.C. §119 of German Application DE 10 2015 110 199.8 filed Jun. 25, 2015, the entire contents of which are incorporated herein by reference.

FIELD OF THE INVENTION

The present invention pertains to an exhaust muffler for the exhaust gas stream of an internal combustion engine, especially a vehicle internal combustion engine, comprising in a muffler housing a first chamber and a second chamber, an exhaust gas inlet, wherein said exhaust gas inlet is open towards the first chamber in a first inlet opening area and is open towards the second chamber in a second inlet opening area; an exhaust gas outlet, wherein the exhaust gas outlet is open towards the first chamber in an outlet opening area; at least one connection opening between the first chamber and the second chamber; an exhaust valve arrangement associated with the at least one connection opening with a valve element, comprising a closing area closing the at least one connection opening in a closed position of the exhaust valve arrangement.

BACKGROUND OF THE INVENTION

Such an exhaust muffler is known from DE 197 20 410 A1. The exhaust gases released by an internal combustion engine flow in this prior-art exhaust muffler into the first chamber in the muffler housing via an inlet pipe or a first inlet opening area provided thereon and into the second chamber in the muffler housing via a second inlet opening area provided at one end of the inlet pipe. A connection pipe providing a connection opening between the second chamber and the first chamber is closed by an exhaust valve arrangement at its end area located in the first chamber. The exhaust valve arrangement is prestressed by a spring in the direction of a closed position, in which the connection pipe and hence the connection opening provided thereby between the second chamber and the first chamber is closed. At a sufficient speed of the internal combustion engine and hence with increased exhaust gas stream, or increasing exhaust gas pressure in the inlet pipe, the exhaust gas pressure in the second chamber and hence also in the connection pipe is increased by exhaust gases entering the second chamber in the second inlet opening area until the exhaust valve arrangement opens against the closing force provided by the spring.

An exhaust valve arrangement, which comprises a valve element pivotable in an exhaust pipe between a closed position and an open position, is known from DE 10 2004 040 631 B3. The valve element is prestressed in the direction of the closed position by a leg spring acting on the valve element. The valve element can be pivoted by the exhaust gas pressure against the prestressing force generated by the leg spring in the direction of its open position.

U.S. Pat. No. 7,434,570 B2 discloses a valve element of an exhaust gas arrangement, which valve element is pivotable in an exhaust pipe between a closed position and an open position. The valve element is coupled with a lever for being pivoted together. A spring acting on the valve element in the direction of the closed position acts on the lever. The effective lever arm, with which the spring force acts on the lever, decreases during the pivoting of the valve element from the closed position to the open position and the accompanying pivoting of the lever, so that the action of the spring, which is increasingly stressed during the pivoting of the valve element to its open position, increases degressively.

SUMMARY OF THE INVENTION

An object of the present invention is to provide an exhaust muffler for an exhaust gas stream of an internal combustion engine, especially vehicle internal combustion engine, which has a simple design and can provide a reliable and effective muffling effect.

This object is accomplished according to the present invention by an exhaust muffler for the exhaust gas stream of an internal combustion engine, especially vehicle internal combustion engine, comprising a muffler housing with a first chamber and a second chamber and an exhaust gas inlet. The exhaust gas inlet is open towards the first chamber in a first inlet opening area and is open towards the second chamber in a second inlet opening area. The muffler also has an exhaust gas outlet. The exhaust gas outlet is open towards the first chamber in an outlet opening area. At least one connection opening is provided between the first chamber and the second chamber. An exhaust valve arrangement comprises a valve element. The exhaust valve arrangement is associated with the at least one connection opening, comprising a closing area closing the at least one connection opening in a closed position of the exhaust valve arrangement.

Provisions are, further, made for the exhaust valve arrangement to comprise an actuating area associated with the second inlet opening area for generating an actuating force by exhaust gas bypass flow. The actuating force acts on the exhaust valve arrangement to move the exhaust valve arrangement from the closed position in the direction of an open position.

The area of the exhaust valve arrangement that is provided essentially for preventing or limiting an exhaust gas flow from the second chamber to the first chamber and the area in which an actuating force moving the exhaust valve arrangement in the direction of the open position is generated by the action of exhaust gas or exhaust gas bypass flow are separated from one another structurally and in space in the exhaust muffler configured according to the present invention. While the closing area interacts with the at least one connection opening, the actuating area interacts with the second inlet opening area or with an exhaust gas stream entering the second chamber in the second inlet opening area. This makes it possible to configure the exhaust valve arrangement with these two mutually independently configurable areas in an optimized manner for ensuring the functionalities to be provided by these.

To make it possible to achieve an interaction with the at least one connection opening, on the one hand, and with the second inlet opening area, on the other hand, in a simple manner, it is proposed that the exhaust valve arrangement be arranged essentially in the second chamber.

To make it possible to effectively prevent or limit the exhaust gas flow from the second chamber to the first chamber, it is proposed that the closing area comprise a valve flap area covering the at least one connection opening preferably on a side facing the second chamber at least partly in the closed position of the exhaust valve arrangement. This makes it possible, in particular, to generate a load of the closing area in the direction of the closed position of the exhaust valve arrangement by the exhaust gas pressure present in the second chamber, so that a force action loading the exhaust valve arrangement in the direction of the closed position is generated by the exhaust gas pressure or the pressure difference between the second chamber and the first chamber alone in the closing area. It is therefore not absolutely necessary to provide additional members, e.g., a prestressing spring, by which the valve element is biased (stressed) in the direction of the closed position of the exhaust valve arrangement.

To avoid impact noises when the valve element is approaching the closed position of the exhaust valve arrangement, it is proposed that an impact damping device be associated with the valve element for damping impacts during the motion of the valve element in the direction of the closed position of the exhaust valve arrangement.

For the interaction of the impact damping device with the different components, whose mutual impact against each other is to be damped, the impact damping device may comprise impact damping material. The impact damping material is provided on a component providing the at least one connection opening or/and on a component providing the at least one connection opening or/and on the valve element in its component providing the second inlet opening area or/and on the area interacting with the component providing the at least one connection opening.

To make it possible to set defined pressure and force conditions for acting on the valve element, it is proposed that a first leak opening device be provided for providing an exhaust gas leak flow from the second chamber to the first chamber with the exhaust valve arrangement positioned in the closed position. In particular, provisions may be made in this connection for the first leak opening device to comprise at least one flowthrough opening in the closing area or/and in a component providing the at least one connection opening or/and between the closing area and a component providing the at least one connection opening. It is seen here that in the sense of the present invention, the statement that the exhaust valve arrangement or its closing area closes the connection opening between the second chamber and the first chamber does not necessarily mean that a perfect closure preventing any flow must be provided here.

According to another, especially advantageous aspect of the invention, when the exhaust valve arrangement is positioned in the closed position, the closing area is loaded in the direction of the closed position based on a pressure difference existing between the second chamber and the first chamber. Thus, it is no longer absolutely necessary to provide additional members loading the exhaust valve arrangement in the direction of the closed position, e.g., a prestressing spring.

To provide a simplified configuration, functions can be combined by the impact damping device providing at least one part of the first leak opening device. In particular, provisions may be made for the impact damping device to comprise flexible, porous impact-absorbing material, preferably wire mesh. It should be noted here that in the sense of the present invention, a wire mesh material is a material formed from metal wire having a porous structure, for example, wire mesh, knitted wire, wire cloth or nonwoven wire material.

Provisions may likewise be made for providing a defined load in the direction of the closed position, especially also when an exhaust gas stream is not present, for the exhaust valve arrangement to be loaded by the action of a supporting force in the direction of the closed position. The supporting force action may be provided, for example, by spring force or/and the force of gravity.

Since the interaction area of the exhaust valve arrangement with the exhaust gas stream decreases, in general, with increasing opening of the exhaust valve arrangement, it is, further, proposed that the supporting force action degressively increase during the motion of the exhaust valve arrangement from the closed position to the open position. The consequence of this increase in the supporting force action is that an oscillation occurring at the time of opening of the exhaust valve arrangement can be avoided.

This increase characteristic of the supporting force action can be provided, for example, by a supporting force arrangement comprising a supporting force spring acting on the valve element for pivoting in the direction of the closed position of the exhaust valve arrangement with level action, wherein an effective lever arm decreases in at least some areas during the pivoting of the valve element from the closed position of the exhaust valve arrangement in the direction of the open position of the exhaust valve arrangement. It is achieved due to the decrease in the effective lever arm that the torque acting on the valve element increases degressively during pivoting in the direction of the open position.

To make it possible to provide the actuating force for opening the exhaust valve arrangement in a simple and reliable manner by interaction of the actuating area with the exhaust gas pressure or exhaust gas stream occurring at the second inlet opening area, it is proposed that the actuating area comprise an actuating flap area at the valve element, which said flap area at least partially covers the second inlet opening area preferably on a side facing the second chamber in the closed position of the exhaust valve arrangement.

To make it possible to provide defined pressure and flow conditions in this area as well, especially when the exhaust valve arrangement is positioned in the closed position, it is, further, proposed that a second leak opening device be provided for providing an exhaust gas leak flow from the exhaust gas inlet into the second chamber when the exhaust valve arrangement is positioned in the closed position. An acoustic connection is, further, provided between the two chambers by providing this second leak opening device, so that these chambers can contribute to muffling, interacting in the manner of a Helmholtz resonator.

The second leak opening device may comprise at least one flowthrough opening in the actuating area or/and in a component providing the second inlet opening area or/and between the actuating area and a component providing the second inlet opening area.

An oscillation-avoiding positioning of the valve element or of the exhaust valve arrangement in a position different from the closed position, for example, in the open position, can be achieved or supported by the actuating area comprising at least one and preferably a plurality of flow guide elements around which exhaust gas can flow. The flow guide elements around which exhaust gas can flow stabilize the position of the actuating area and hence of the valve element in the exhaust gas stream.

To make it possible to make the muffling effect even more efficient in the muffler according to the present invention, it is proposed that a third chamber preferably containing muffling material be provided in the muffler housing between the first chamber and the second chamber.

To obtain the different exhaust gas flow paths from the exhaust gas inlet to the exhaust gas outlet, partly via the second chamber, it is proposed that the exhaust gas inlet comprise at least one inlet pipe, which passes through the first chamber and the third chamber, is open towards the first chamber in the first inlet opening area and is open towards the second chamber in the second inlet opening area, or/and that the exhaust gas outlet comprise at least one outlet pipe, which passes through the second chamber and the third chamber and is open towards the first chamber in the outlet opening area, or/and that at least one connection pipe, which passes through the third chamber and is open towards the first chamber and the second chamber for providing a connection opening.

The present invention pertains, further, to an exhaust valve arrangement, which can be used in the above-described exhaust muffler in an especially advantageous manner. This exhaust valve arrangement may comprise a valve element with a closing area, which can be positioned such that it at least partially prevents an exhaust gas flow in a closed position of the exhaust valve arrangement, and with an actuating area generating an actuating force acting on the exhaust valve arrangement in the direction of an open position.

To make it possible to set defined pressure and flow conditions, which are essentially unaffected by manufacturing and assembly tolerances, it is proposed that at least one flowthrough opening be provided in the closing area for providing an exhaust gas leak flow when the exhaust valve arrangement is positioned in the closed position, or/and in such an exhaust valve arrangement even in the closed position thereof, or/and that at least one flowthrough opening be provided in the actuating area for providing an exhaust gas leak flow when the exhaust valve arrangement is positioned in the closed position, or/and that at least one flow guide element be provided.

Provisions may, further, be made for at least one valve spring to be provided for acting on the valve element in the direction of the closed position of the exhaust valve arrangement, wherein such action on the valve element increases degressively during the motion of the valve element from the closed position of the exhaust valve arrangement in the direction of an open position of the exhaust valve arrangement.

To make it possible to generate a load acting on the valve element in the direction of the closed position by an exhaust gas pressure difference in the area of the closing area in the valve element according to the present invention, on the one hand, and to make it possible to generate, on the other hand, an actuating force for moving the valve element in the direction of the open position in the actuating area by exhaust gas bypass flow or by an exhaust gas pressure difference, it is, further, proposed that the valve element be pivotable about a pivot axis in a pivoting range and that the actuating area be provided at a greater distance from the pivoting range than the closing area.

The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
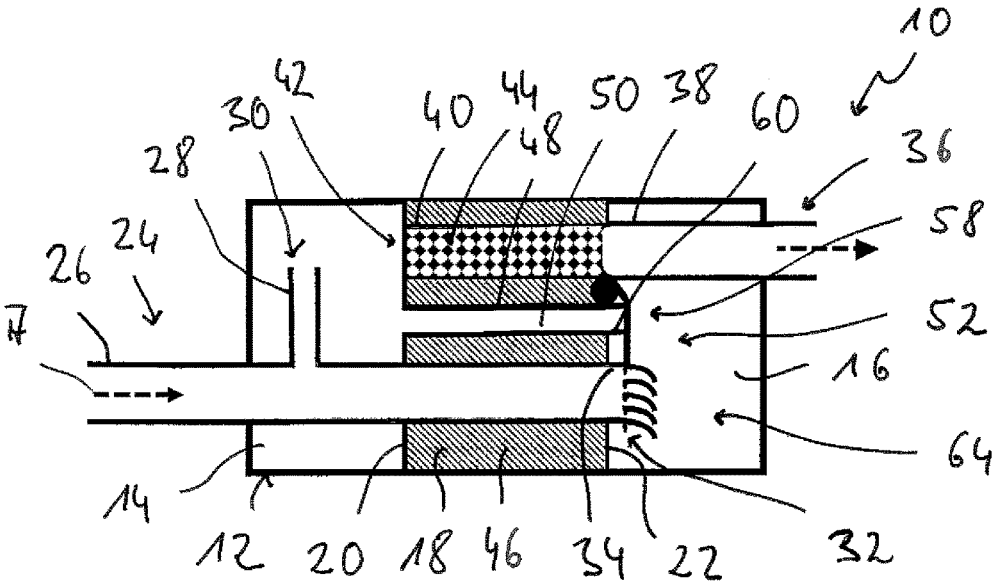
FIG. 1 is a schematic diagram of an exhaust muffler for an exhaust gas stream of an internal combustion engine.

An exhaust muffler 10 shown in FIG. 1 comprises a muffler housing 12. A first chamber 14, a second chamber 16 as well as a third chamber 18 between the first chamber 14 and the second chamber 16 are formed in the muffler housing 12. The first chamber 14 is separated from the third chamber 18 by a wall 20. The third chamber 18 is separated from the second chamber 16 by a wall 22.

An inlet pipe 26 providing essentially an exhaust gas inlet 24 leads into the muffler housing 12 in the area of the first chamber 14. In its area extending into the first chamber 14, the inlet pipe 24 has a first inlet opening area 30, which is provided, for example, by a branch pipe 28 positioned such that it branches off from the inlet pipe 26. The inlet pipe 26 is open towards the first chamber 14 in this first inlet opening area 30. The inlet pipe 26 passes through the first chamber 14, the wall 20, the third chamber 18 and the wall 22 and extends into the second chamber 16, for example, with an end area 34 providing a second inlet opening area 32.

An outlet pipe 38 providing essentially an exhaust gas outlet 36 is open in its end area 40 located, for example, in the area of the wall 20 towards the first chamber 14 in an outlet opening area 42. The outlet pipe 38 passes through the third chamber 18, the wall 22 and the second chamber 16. In its longitudinal area extending into the area of the third chamber 18, the outlet pipe 38 may have a plurality of passage openings 44, via which the outlet pipe 38 is open towards the third chamber 18. The third chamber 18 is preferably filled, furthermore, with muffling material 46, for example, porous or fibrous material. The third chamber 18 is in acoustic connection via the openings 44 with the interior of the outlet pipe 38, so that a muffling effect can also be achieved by reflection or absorption in interaction with the muffling material 46 positioned in the third chamber 18. It should be noted that the exhaust gases A entering the muffler housing 12 via the inlet pipe 26 and leaving the muffler housing 12 via the outlet pipe 38 cannot flow, in principle, through the third chamber 18.

The first chamber 14 is, further, in connection with the second chamber 16 via a connection pipe 48 passing through the third chamber 18 and the walls 20, 22. The connection pipe 48 provides a connection opening 50 between the first chamber 14 and the second chamber 16.

Figure 2:
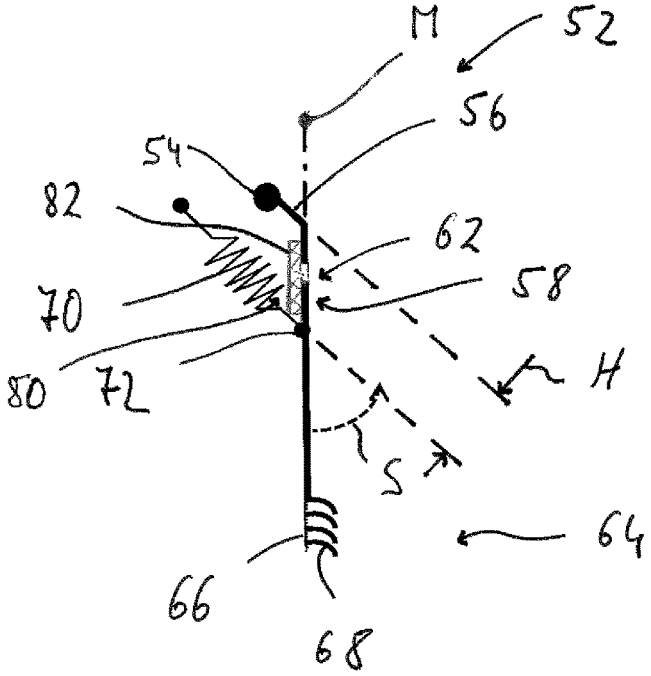
FIG. 2 is a schematic diagram of an exhaust valve arrangement that can be used on the exhaust muffler according to FIG. 1.

A valve arrangement 52 shown in more detail in FIG. 2 is arranged essentially in the second chamber 16 and in the area in which the second chamber 16 adjoins the third chamber 18. The exhaust valve arrangement 52 comprises a valve element 56, which is pivotable in a pivoting range 54, for example, at the wall 22, about a pivot axis that extends at right angles to the drawing plane of FIGS. 1 and 2. In its area located close to the pivoting range 54, the valve element 56 provides a valve flap-like closing area 58, with which it can be brought into closing interaction with the connection pipe 48 providing the connection opening 50. As this can be seen in, for example, FIG. 1, an end area 60 of the connection pipe 48 may extend into the second chamber 16, so that the closing area 58 of the valve element 56 is positioned in a closed position of the exhaust valve arranged 52, which position is shown in FIG. 1 such that it covers the end area 60 of the connection pipe 48 and thus essentially closes the connection opening 50. At least one flowthrough opening 62, through which a defined flow cross section is provided for a leak flow from the second chamber 16 to the first chamber 14 even when the closing area 58 is in contact with the end area 60 of the connection pipe 48 and covers the connection opening 50, can be provided in the closing area 58. The flowthrough opening 62 may also be provided by one or more small tubes provided at the valve element 56 because of acoustic advantages.

An actuating area 64 is provided in the section of the valve element 56 located farther away from the pivoting range 54. This actuating area 64 is configured or positioned such that it covers the end area 34 in the manner of a valve flap, especially in the closed position of the exhaust valve arrangement 52, in the area of the second inlet opening area 32, i.e., in the area of the end area 34 of the inlet pipe 26.

In the actuating area 64 the valve element 56 has one or more flowthrough openings 66, through which a leak flow or exhaust gas flow is made possible from the inlet pipe 26 in the second inlet opening area 32 to the second chamber 16 also when the exhaust valve arrangement 52 is positioned in the closed position. Further, a plurality of rib-like or fin-like flow guide elements 68, between which exhaust gas passage ducts are formed, are provided in the example being shown in the actuating area 64 of the valve element 56. These flow guide elements 68, which are provided, for example, by separately arranged components or by notches or bulges, guide the exhaust gases, which flow around the actuating area 64 and especially also through the flowthrough openings 66, in a defined manner and thus lead to a stable exhaust gas flow, on the one hand, and to a stabilization of the position of the valve element 56 in the exhaust gas stream, on the other hand, during the flow of exhaust gases around the actuating area 64. An acoustic connection is established between the first chamber 14 and the second chamber 16 by the flowthrough openings 66 even when the actuating area 64 covers the inlet pipe 26 in the closed position of the exhaust valve arrangement.

FIG. 2 shows, further, associated with the valve element 56, a spring 70 acting on the said valve element in the direction of the closed direction of the exhaust valve arrangement 52. This spring 70 acts, on the one hand, on the valve element 56, for example, between the closing area 58 and the actuating area 64. On the other hand, the spring 70 acts on a fixed component or assembly unit, for example, the wall 22 or the connection pipe 48, or on a component that is to be associated with the exhaust valve arrangement 52 and mounts the valve element 56 pivotably in the pivoting range 54. Due to the spring 70 or the point 72 at which the spring acts on the valve element 56 being laterally offset in relation to the pivoting range 54, an effective lever arm H, with which the spring 70 acts on the valve element 56, is obtained in the closed position of the valve arrangement 52, so that, taking the spring force provided by the spring 70 into account, the valve element 56 is loaded with a torque determined by the spring force, on the one hand, and by the effective lever arm H, on the other hand, in the direction of the closed position. If the valve element 56 pivots, starting from the pivoted position, which is shown in FIG. 1 and in FIG. 2 and corresponds to the closed position of the valve arrangement 52, in the direction of an open position of the exhaust valve arrangement 52, which corresponds to a counterclockwise pivoting in the direction of an arrow S, the effective lever arm decreases with increasing stress of the spring 70 and hence also with increasing spring force provided by the spring 70. The consequence of this is that even though the action of the force loading the valve arrangement 52 (valve element 56) in the direction of the closed position of the exhaust valve arrangement 52 increases, this increase takes place to a lower extent, i.e., degressively, because of the decreasing effective lever arm. This is also supported by the circumstance that the change in the length of the spring occurring per unit of pivot angle during pivoting in the direction of the open position decreases.

FIGS. 1 and 2 show that, independently from the provision of the spring 70, the valve element 56 is also loaded, supported by the force of gravity, because of the angular outer shape of said valve element 56, in the direction of the closed position of the exhaust valve arrangement 52 or can be positioned such that such an action on the valve arrangement 52, supported by the force of gravity, takes place in the direction of the closed position. It is thus possible, in principle, to dispense with providing a spring 70 for prestressing or holding the valve arrangement 52 (valve element 56) in the closed position. To make it possible to provide the degressively increasing supporting force action in case of such a prestressing of the valve element 56, supported by the force of gravity, in the direction of the closed position of the exhaust valve arrangement 52 in a simple manner, an additional mass M may, for example, be provided at the valve element 56. This mass may be arranged offset to the pivoting range 54, i.e., to provide a lever action. If the valve element 56 pivots counterclockwise in the view shown in FIG. 2, then the effective lever arm provided by the additional mass M can decrease, as a result of which the action of the force provided by the additional mass M and loading the valve element 56 in the direction of the closed position of the valve arrangement 52 will decrease as well. Provisions may be made now for the additional mass M to move in the horizontal direction beyond the pivoting range 54 and then generating an action of force loading the valve element 56 in the direction of the open position thereof. Consequently, by providing such an additional mass M, it is possible to obtain such a position of the overall center of gravity on the valve element 56 that even though the force loading the valve element 56 in the direction of the closed position of the valve arrangement 52 increases, in principle, during deflection from the closed position and motion in the direction of the open position, a degressive increase of the action of this supporting force is achieved.

To avoid impact noises when the valve element 56 is approaching the inlet pipe 26 or the connection pipe 48 starting from the open position during motion in the direction of the closed position of the valve arrangement 52, an impact damping device 80 is associated with the valve element 56. The impact damping device 80 is provided in the example shown in FIG. 2 in the area of the valve element 56 that interacts with the connection pipe 48. When the valve element 56 is approaching with this area the connection pipe 48 during motion in the direction of the closed position of the valve arrangement 52, impact damping material 82 of the impact damping device 80 comes into contact with the connection pipe 48. The impact damping material 82 is preferably a porous, flexible material, which is deformable when the valve element 56 is approaching the connection pipe 48. For example, wire mesh material fixed on the valve element by welding, preferably resistance welding, which material has, for example, a ring-shaped structure for interaction with the connection pipe 48, may be provided here on the valve element 56. Such wire mesh material may, further, be used to permit a leak flow into the connection pipe 48 on account of its porous structure. The impact damping material 82 can consequently permit an exhaust gas flow between the second chamber 16 and the first chamber 14 via the connection pipe 48 even when it is positioned between the connection pipe 48 and the valve element 56, i.e., when the valve element 56 is consequently in contact with the end area 60 of the connection pipe 48 via the impact damping material 82. As an alternative or in addition, such impact damping material could also be provided in the area of the valve element 56 in which this interacts with the end area 34 of the inlet pipe 26. To also guarantee the leak flow now via the connection pipe 48, the arrangement may be such, instead of or in addition to the provision of the flowthrough opening 62, that the closing area 58 of the valve element 56 is held at a distance from the end area 60 of the connection pipe 48 by the impact damping material, which is positioned between the valve element 56 and the end area 34 of the inlet pipe 26. Further, it should be noted that, as an alternative or in addition, such impact damping material 82 may also be provided at the end area of the connection pipe 48 or/and at the end area 34 of the inlet pipe 26.

The exhaust gases A released by the internal combustion engine enter the muffler housing 12 via the inlet pipe 26 during the operation of an internal combustion engine, whose exhaust system is equipped with the exhaust muffler 10. A larger part of the exhaust gases A can flow into the first chamber 14 via the first inlet opening area 30. The exhaust gases A flow from the first chamber 14 through the outlet pipe 38 and thus enter the part of the exhaust system that leads farther and are released into the surrounding area. Based on the flowthrough openings 66 in the actuating area 64, on the one hand, and the flowthrough opening(s) 62 in the closing area 58, on the other hand, a part of the exhaust gas stream enters the second chamber 16 via the second inlet opening area 32 and the first chamber 14 via the connection pipe 48 and the connection opening 50. An exhaust gas pressure, which will be higher than the exhaust gas pressure in the first chamber 14, which is generally open to the surrounding area via the outlet pipe 38, builds up in the process in the second chamber 16. Due to this pressure difference, the closing area 58 of the valve element 56 is loaded in the direction of the connection pipe 48, so that the valve arrangement 52 is prestressed, in principle, towards its closed position by the pressure difference building up between the second chamber 16 and the first chamber 14. As was already described above, this prestress can be supported by an optionally present spring 70 or/and by the force of gravity acting on the valve element 56.

An increasing actuating force, which loads the actuating area 64 to move in the direction away from the inlet pipe 26, will also develop at the actuating area 64 with increasing speed of an internal combustion engine and hence with increasing exhaust gas stream or exhaust gas pressure in the inlet pipe 26. When a speed limit or an exhaust gas pressure limit is reached, the actuating force generated in the actuating area 64 exceeds the closing force present in the closing area 58 due to the pressure difference, which may, on the one hand, also be due to and supported by the fact that the inlet pipe 26 has a larger cross section than the connection pipe 48, and that, on the other hand, the actuating area 64 has a greater distance and hence a greater lever arm in relation to the pivoting range 54 than does the closing area 58. This causes the valve element 56 to pivot, starting from the position shown in FIGS. 1 and 2, and to increasingly release the connection opening 50 between the second chamber 16 and the first chamber 14 with increasing pivoting. The consequence of this is that an increasing portion of the exhaust gas stream flows via the second chamber 16 and the connection pipe 48 into the first chamber 14 and via this into the exhaust pipe 38.

By providing the flow guide elements 68 at the actuating area 64 of the valve element 56, it is ensured that the valve element 56, which is deflected in the closed position, is held in the exhaust gas stream, in a stable manner, so that the risk of oscillations of the valve element 56 is avoided. Also contributing to this is the fact that the presence of a spring providing a supporting force, e.g., the spring 70, can be completely dispensed with, or that, if the spring 70 is provided, this provides the action of a degressively increasing force during pivoting of the valve element 56 in the direction of the open position of the exhaust valve arrangement 52. Dispensing with a spring element providing such a supporting action has, further, the advantage that aging-related changes in the force characteristics of such a spring element exposed to the comparatively hot exhaust gas stream can be avoided.

It should be noted that the exhaust muffler shown in FIG. 1 may be varied in many different ways without departing from the principles of the present invention. Thus, the supporting force provided by a spring element could be provided not necessarily by a tension coil spring but, for example, by a spring of a different configuration, e.g., a coil spring, leaf spring or omega spring or combinations of different spring elements. The valve element could also be arranged pivotably in another position, for example, at the muffler housing to be able to nevertheless close the connection opening and the second inlet opening area in the above-described manner while maintaining a defined leak flow. It would also be possible to optionally dispense with the third chamber, in which case a wall separating the second chamber from the first chamber, in which wall the connection opening or the second inlet opening area may be provided, for example, by means of corresponding openings or pipes passing through this wall, is to be provided.

While specific embodiments of the invention have been shown and described in detail to illustrate the application of the principles of the invention, it will be understood that the invention may be embodied otherwise without departing from such principles.

What is claimed is:

1. An exhaust muffler for an exhaust gas stream of a vehicle internal combustion engine, the muffler comprising:

a housing with a first chamber and a second chamber;

an exhaust gas inlet open towards the first chamber in a first inlet opening area and open towards the second chamber in a second inlet opening area;

an exhaust gas outlet open towards the first chamber in an outlet opening area;

at least one connection opening between the first chamber and the second chamber; and an exhaust valve arrangement arranged in the second chamber and associated with the at least one connection opening, the valve arrangement comprising a valve element with a closing area closing the at least one connection opening in a closed position of the exhaust valve arrangement, the exhaust valve arrangement comprising an actuating area associated with the second inlet opening area, the actuating area generating an actuating force due to an exhaust gas bypass flow acting on the actuating area, said actuating force moving the exhaust valve arrangement from the closed position in a direction of an open position for thereby releasing the connection opening.

2. An exhaust muffler in accordance with claim 1, wherein the closing area comprises a valve flap area, which covers the at least one connection opening at least partly, on a side facing the second chamber, in the closed position of the exhaust valve arrangement.

3. An exhaust muffler in accordance with claim 1, wherein the valve arrangement further comprises an impact damping device associated with the valve element for damping an impact during motion of the valve element in a direction of the closed position of the valve arrangement.

4. An exhaust muffler in accordance with claim 3, wherein the impact damping device comprises impact damping material provided on a portion of the exhaust gas inlet providing the second inlet opening area or on the connection opening or on the valve element in a valve element area interacting with the portion providing the second inlet opening area or on a valve element area interacting with the connection opening or any combination of on the portion of the exhaust gas inlet providing the second inlet opening area and on the connection opening and on the valve element in a valve element area interacting with the portion providing the second inlet opening area and on a valve element area interacting with the connection opening.

5. An exhaust muffler in accordance with claim 1, wherein a first chamber leak flow arrangement is provided for providing an exhaust gas leak flow from the second chamber to the first chamber with the exhaust valve arrangement positioned in the closed position.

6. An exhaust muffler in accordance with claim 5, wherein the first chamber leak flow arrangement comprises at least one flowthrough opening in the closing area or in the connection opening or between the closing area and the connection opening.

7. An exhaust muffler in accordance with claim 3, wherein:

a first leak opening device is provided for providing an exhaust gas leak flow from the second chamber to the first chamber with the exhaust valve arrangement positioned in the closed position; and the impact damping device provides at least one part of the first leak opening device.

8. An exhaust muffler in accordance with claim 7, wherein the impact damping device comprises flexible, porous impact-absorbing material comprising a wire mesh material.

9. An exhaust muffler in accordance with claim 1, wherein with the exhaust valve arrangement positioned in the closed position, the closing area is biased in a direction of the closed position because of a pressure difference existing between the second chamber and the first chamber.

10. An exhaust muffler in accordance with claim 1, wherein the exhaust valve arrangement is biased by the action of a supporting force in a direction of the closed position.

11. An exhaust muffler in accordance with claim 10, wherein the supporting force action is provided by spring force of a spring or by gravity force or by both spring force and gravity force.

12. An exhaust muffler in accordance with claim 10, wherein the supporting force action increases degressively during the motion of the exhaust valve arrangement from the closed position to the open position.

13. An exhaust muffler in accordance with claim 12, wherein the supporting force is provided by a supporting force arrangement comprising a supporting force spring acting on the valve element for pivoting the valve element in a direction of the closed position of the exhaust valve arrangement and a lever arm that decreases in at least some areas during the pivoting of the valve element from the closed position of the exhaust valve arrangement in a direction of the open position of the exhaust valve arrangement.

14. An exhaust muffler in accordance with claim 1, wherein the actuating area comprises an actuating flap area at the valve element, said flap area covering the second inlet opening area in the closed position of the exhaust valve arrangement at least partly on a side facing the second chamber.

15. An exhaust muffler in accordance with claim 14, wherein a second chamber leak opening device is provided for providing an exhaust gas leak flow from the exhaust gas inlet into the second chamber when the exhaust valve arrangement is positioned in the closed position.

16. An exhaust muffler in accordance with claim 15, wherein the second chamber leak opening device comprises at least one flowthrough opening in the actuating area or in the second inlet opening area or between the actuating area and the second inlet opening area.

17. An exhaust muffler in accordance with claim 1, wherein the actuating area comprises at least one flow guide element, through which exhaust gas flows.

18. An exhaust muffler in accordance with claim 1, wherein the housing has a third chamber and further comprising muffling material in the third chamber wherein the third chamber is between the first chamber and the second chamber.

19. An exhaust muffler in accordance with claim 18, wherein:

the exhaust gas inlet comprises at least one inlet pipe passing through the first chamber and the third chamber and open towards the first chamber in the first inlet opening area and is open in the second inlet opening area towards the second chamber; or the exhaust gas outlet comprises at least one outlet pipe passing through the second chamber and the third chamber and open in the outlet opening area towards the first chamber; or the connection opening comprises at least one connection pipe passing through the third chamber and open towards the first chamber and towards the second chamber; or and combination of the exhaust gas inlet comprises at least one inlet pipe passing through the first chamber and the third chamber and open towards the first chamber in the first inlet opening area and is open in the second inlet opening area towards the second chamber, and the exhaust gas outlet comprises at least one outlet pipe passing through the second chamber and the third chamber and open in the outlet opening area towards the first chamber, and the connection opening comprises at least one connection pipe passing through the third chamber and open towards the first chamber and towards the second chamber.

20. An exhaust valve arrangement comprising:

a valve element with a closing area positioned in a closed position of the exhaust valve arrangement such that the valve element at least partially prevents an exhaust gas flow through a first opening; and an actuating area, which generates an actuating force acting on the exhaust valve arrangement in a direction of an open position by exhaust gas bypass flow through a second opening different from the first opening acting on the actuating area.

21. An exhaust valve arrangement in accordance with claim 20, wherein:

at least one flowthrough opening is provided in the closing area for providing an exhaust gas leak flow when the exhaust valve arrangement is positioned in the closed position; or at least one flowthrough opening is provided in the actuating area for providing an exhaust gas leak flow when the exhaust valve arrangement is positioned in the closed position; or at least one flow guide element; or any combination of at least one flowthrough opening is provided in the closing area for providing an exhaust gas leak flow when the exhaust valve arrangement is positioned in the closed position and at least one flowthrough opening is provided in the actuating area for providing an exhaust gas leak flow when the exhaust valve arrangement is positioned in the closed position and at least one flow guide element.

22. An exhaust valve arrangement in accordance with claim 20, wherein at least one valve spring is provided for acting on the valve element in a direction of the closed position of the exhaust valve arrangement, wherein such an action degressively increases during the motion of the valve element from the closed position of the exhaust valve arrangement in the direction of an open position of the exhaust valve arrangement.

23. An exhaust valve arrangement in accordance with claim 20, wherein:

the valve element is pivotable in a pivoting range about a pivot axis; and the actuating area is provided at a greater distance from the pivoting range than the closing area.

24. An exhaust muffler for an exhaust gas stream of a vehicle internal combustion engine, the muffler comprising:

a housing comprising a first chamber and a second chamber;

an exhaust gas inlet open towards the first chamber in a first inlet opening area and open towards the second chamber in a second inlet opening area;

an exhaust gas outlet open towards the first chamber in an outlet opening area;

a connection opening between the first chamber and the second chamber; and an exhaust valve arrangement arranged in the second chamber, the valve arrangement comprising a valve element, the valve element comprising a first extent and a second extent, the first extent comprising a closing area, the second extent comprising an actuating area, the valve element comprising a closing position and an open position, the closing area closing the at least one connection opening when the valve element is in the closed position, at least a portion of the actuating area being located opposite the second inlet opening when the valve element is in the closed position, the actuating area generating an actuating force due to an exhaust gas bypass flow acting on the actuating area, the actuating force moving the valve element from the closed position in a direction of the open position, wherein the connection opening is in fluid communication with the second chamber when the valve element is in the open position.

* * * * *